United States Patent [19]

Dahl

[11] Patent Number: 4,915,790

[45] Date of Patent: Apr. 10, 1990

[54] PRESS SECTION OF A PAPERMAKING MACHINE WITH ADJUSTABLE FELT GUIDE ROLL

[76] Inventor: Hans Dahl, Karl Erb-Ring 89, 7980 Ravensburg, Fed. Rep. of Germany

[21] Appl. No.: 282,693

[22] Filed: Dec. 12, 1988

[30] Foreign Application Priority Data

Dec. 17, 1987 [DE] Fed. Rep. of Germany ..... 3742848

[51] Int. Cl.[4] ..... D21F 3/04

[52] U.S. Cl. ..... 162/305; 162/252; 162/358; 162/360.1

[58] Field of Search ..... 162/358, 359, 360.1, 162/305, 306, 252, 256

[56] References Cited

U.S. PATENT DOCUMENTS

| | | | |
|---|---|---|---|
| 3,268,390 | 8/1966 | Ely, Sr. | 162/360.1 |
| 3,278,368 | 10/1966 | Wicker | 162/358 |
| 3,556,940 | 1/1971 | Cronin | 162/358 |
| 3,607,626 | 9/1971 | Nilsson | 162/358 |
| 4,056,433 | 11/1977 | Koponen et al. | 162/360.1 |
| 4,483,745 | 11/1984 | Wicks et al. | 162/206 |
| 4,556,451 | 12/1985 | Ely | 162/205 |
| 4,662,992 | 5/1987 | Mirsberger | 162/207 |
| 4,704,192 | 11/1987 | Cronin | 162/358 |

FOREIGN PATENT DOCUMENTS

| | | |
|---|---|---|
| 3105276 | 8/1982 | Fed. Rep. of Germany . |
| 3307362 | 9/1983 | Fed. Rep. of Germany . |
| 3328162 | 2/1985 | Fed. Rep. of Germany . |

*Primary Examiner*—Karen M. Hastings

[57] ABSTRACT

For dewatering a paper web the pressing or press section has two separate or spaced pressing locations arranged in tandem and comprising extended nips. These pressing locations are each formed between an upper pressing surface and a lower pressing surface. The paper web to be dewatered travels between an upper felt belt and a lower felt belt. One of the felt belts extends through both pressing locations while the other felt belt only travels through the first pressing location as viewed in the direction of travel of the paper web. The paper web is only sandwiched between the two felt belts in the first pressing location. The other felt belt which is guided solely through the first pressing location is diverted away from the paper web directly downstream of the first pressing location by a pivotably mounted guide roll, so that the paper web passes through the second pressing location while being supported solely by the one felt belt guided through both pressing locations. Downstream of the second pressing location the paper web is deflected away from the one felt belt and conveyed to a drying section of the papermaking machine. In this manner, re-wetting of the paper web is reduced following each dewatering operation in the pressing locations. According to one embodiment the upper felt belt is guided through both pressing locations. The lower felt belt extends solely through the first pressing location.

10 Claims, 2 Drawing Sheets

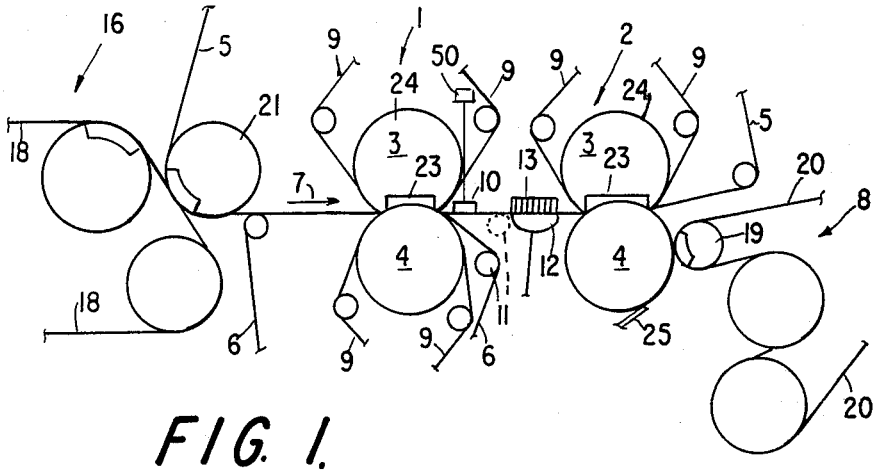
FIG. 1.
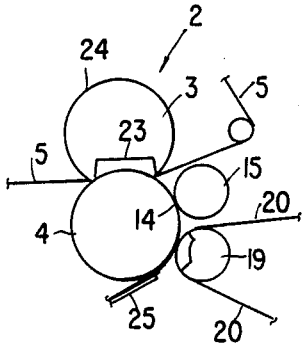
FIG. 2.
FIG. 3.
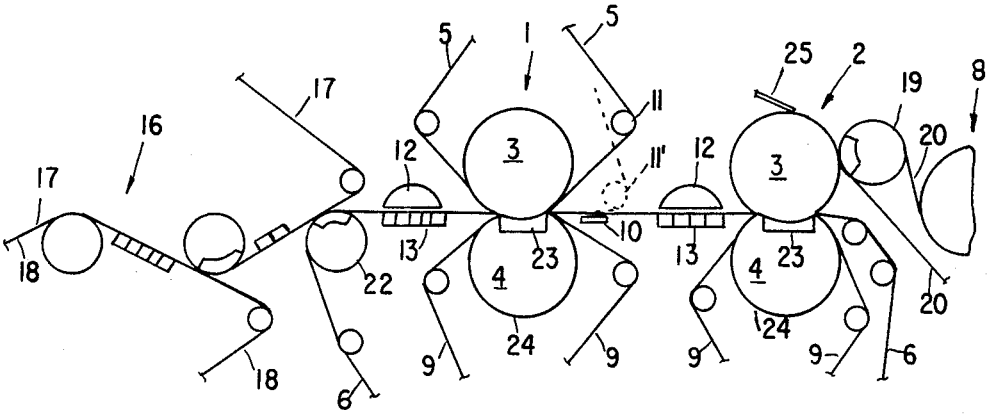

PRESS SECTION OF A PAPERMAKING MACHINE WITH ADJUSTABLE FELT GUIDE ROLL

BACKGROUND OF THE INVENTION

The present invention generally relates to papermaking machines and more specifically concerns a new and improved construction of a pressing or press section for use in a papermaking machine for the dewatering of a paper web or the like.

Generally speaking, the pressing or press section of the present invention is of the type comprising two separate or spaced pressing locations arranged in tandem or succession. Each pressing location comprises an upper pressing surface and a lower pressing surface which define an extended or wide nip therebetween. The paper web to be dewatered is guided between an upper felt belt and a lower felt belt.

It is known to the art, for example, from German Pat. No. 3,328,162, published Feb. 20, 1986, that high-speed papermaking machines require a closed or sandwiched guidance of the paper web up to the drying section of the papermaking machine. The paper web is thus located between an upper felt belt and a lower felt belt and guided therebetween through pressing locations arranged in tandem or in series in the direction of travel of the paper web during linear or straight web guidance.

However, this positive web guidance has the disadvantage that, each time after leaving the respective pressing location, the paper web is re-wet with liquid or moisture which has been previously transferred into the felt belts in that the paper web sucks back such liquid or moisture. This is particularly undesired in the case of so-called extended nip presses, in the extended or long or wide nip of which the rate of dewatering is especially high during the prolonged web residence time in such an extended nip.

SUMMARY OF THE INVENTION

Therefore with the foregoing in mind it is a primary object of the present invention to provide a new and improved construction of a pressing section of a papermaking machine for dewatering a paper web which is not afflicted with the aforementioned drawbacks and shortcomings of the prior art.

Another and more specific object of the present invention aims at providing a new and improved construction of a pressing section of a papermaking machine in which the aforementioned undesirable web re-wetting is substantially and reliably reduced, and also in high speed papermaking machines there is maintained positive web guidance through the extended nip pressing locations as well as intermediate such extended nip pressing locations.

Yet a further significant object of the present invention aims at providing a new and improved construction of a pressing section of the character described which is extremely simple in construction and design, relatively economical to manufacture, and very reliable in operation.

Now in order to implement these and still further objects of the present invention, which will become more readily apparent as the description proceeds, the pressing section of the present invention is, among other things, manifested by the features that a first felt belt extends or travels through both pressing locations arranged in tandem or sequentially while a second felt belt is guided together with the first felt belt only or solely through the first pressing location which is arranged upstream of the second pressing location as viewed in a predetermined direction of travel of the paper web. After passing through this first pressing location the second felt belt is removed or brought out of contact as soon as possible from the paper web, so that the paper web is only supported or carried by, in other words, only contacts the first felt belt when the paper web passes through the second pressing location. The paper web is deflected or diverted away from the first felt belt downstream of the second pressing location and can be guided into a drying section of the papermaking machine. A guide roll of the second felt belt which only travels or extends through the first pressing location is arranged downstream of the first pressing location. This guide roll is positionally adjustable or movable in a direction towards the paper web to ensure the take-over and retention of the paper web by and at the first felt belt guided through both pressing locations.

Downstream of the first pressing location there are provided transfer suction means, for instance a transfer aspirator or suction device, for ensuring the retention and take-over of the paper web at and by the first felt belt travelling or leading through both the separated or spaced pressing locations. The positionally adjustable guide roll together with the associated second felt belt can assume a position of contact with the paper web or the first felt belt, as the case may be, and an operating position when deflected away from the paper web or the first felt belt. The transfer suction means provide a vacuum as a function of which there is controlled the position of the adjustable guide roll. This vacuum or suction is maintained by the resistance of the first felt belt travelling or leading through both pressing locations and, if present, also the paper web. The adjustable guide roll is located at or else guided to the position of contact with the first felt belt or the paper web located therebelow as long as the vacuum is below a predetermined or critical value. When the vacuum exceeds this predetermined or critical value, then the adjustable guide roll is guided to or else retained at the operating position in which the guide roll is deflected away from the paper web.

The angle of aperture or departure or opening angle between the second felt belt and the paper web in the operating position of the adjustable guide roll is advantageously in the range of 2° to 10°.

According to one exemplary embodiment of the pressing section, the first felt belt or felt travelling through both the pressing locations comprises the upper felt belt or felt.

According to another exemplary embodiment of the pressing section, the first felt belt or felt travelling through both the pressing locations comprises the lower felt belt or felt.

Theoretically the previously occurring re-wetting of the outgoing or outbound paper web is nearly reduced by one-half. A trouble-free and linear or straight web guidance is nevertheless ensured.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 schematically shows a first exemplary embodiment of pressing or press section constructed according to the present invention;

FIG. 2 schematically depicts a detail of a modification of the first exemplary embodiment of FIG. 1;

FIG. 3 schematically shows a second exemplary embodiment of pressing or press section constructed according to the present invention;

DETAILED DESCRIPTION OF THE PREFERRED EMBODIMENTS

Figure 4:
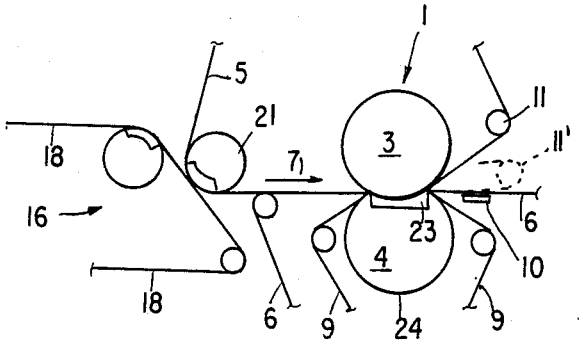
FIG. 4 schematically depicts a detail of a modification of the second exemplary embodiment of FIG. 3.

Describing now the drawings, it is to be understood that to simplify the showing thereof only enough of the structure of the various exemplary embodiments of pressing or press section of a papermaking machine has been illustrated therein as is needed to enable one skilled in the art to readily understand the underlying principles and concepts of the present invention.

Turning now specifically to FIG. 1 of the drawings, the apparatus depicted therein by way of example and not limitation will be seen to comprise a pressing or press section of a high-speed papermaking machine for dewatering a paper web. The pressing section comprises two separate or spaced pressing or press locations 1 and 2 which are arranged in tandem or succession in a predeterminate direction of travel of the paper web. This predeterminate direction of travel has been generally indicated by arrow 7. Each of these separate or spaced pressing or press locations 1 and 2 is formed between two pressing surfaces and in the embodiment under discussion specifically between an upper press roll or roller 3 and a therewith coacting lower press roll or roller 4. There are also depicted an upper felt belt or band 5 and a lower felt belt or band 6 between which the paper web to be dewatered is sandwiched and guided through the pressing or press location 1. For the sake of illustration simplicity the paper web has not been particularly illustrated in the drawings.

Figure 6:
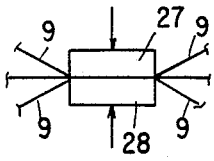
FIG. 6 schematically shows a pressing location between two substantially planar pressing surfaces.

At this point it is mentioned that it is conceivable to also provide pressing or press locations between two planar pressing surfaces defined by substantially flat pressing shoes 27 and 28 as shown in FIG. 6.

One of the felt belts or bands, which in the embodiment of FIG. 1 comprises the upper felt belt or band 5, extends through both of the pressing or press locations 1 and 2. On the other hand, the lower felt belt or band 6 travels together with the upper felt belt or band 5 only through the first or upstream pressing or press location 1 as viewed with respect to the predeterminate direction of travel 7 of the paper web. After passing through the first or upstream pressing or press location 1 the lower felt belt or band 6 is downwardly deflected or guided away as soon as possible from the paper web and separated therefrom, so that the paper web cannot suck back any moisture from the lower felt belt or band 6. In the further course of travel to the second or downstream located pressing or press location 2, the paper web is here supported by the upper felt belt or band 5. To ensure the proper take-over and the retention of the paper web by and at the upper felt belt or band 5 there is provided a transfer aspirator or suction device 10 downstream of the first or upstream pressing or press location 1. For the same purpose or for augmenting such purpose a displaceable or adjustable guide roll or roller 11 of the deflected lower felt belt or band 6 is located downstream of the first or upstream pressing or press location 1 and arranged to be pivotably adjustable or positionable by any suitable and conventional roll adjusting or positioning means in the direction toward the paper web or the upper felt belt 5 travelling to the second or downstream pressing or press location 2. The resulting position of contact of the guide roll or roller 11 with the paper web or the upper felt belt 5, as the case may be, and as shown by the dotted line position of the guide roll 11 in FIG. 1, comprises the start-up or starting position which provides a positive web guidance but has the disadvantage of re-wetting. The swung-out or downwardly displaced position of the guide roll 11 constitutes an operating position thereof and avoids re-wetting of the paper web.

The position of the guide roll 11 can be controlled as a function of the vacuum of the transfer aspirator or suction device 10. This vacuum or suction which is maintained by the resistance of the upper felt belt 5 and the paper web if present bearing against the transfer aspirator or suction device 10 is constantly measured by the vacuum of suction measuring means 50 schematically shown in FIG. 1. When the magnitude of such vacuum or suction exceeds a certain limiting or critical value such constitutes an indication that the paper web is bearing against the upper felt belt or band 5 and that the guide roll or roller 11 together with the lower felt belt or band 6 now can be pivoted or swung away from the upper felt belt or band 5 and the paper web lying therebelow so as to assume the full line operating position shown in FIG. 1. On the other hand, when the vacuum or suction has a magnitude below this limiting or critical value then such signifies that no paper web is bearing against the upper felt belt or band 5. In such case, by applying the lower felt belt 6 to the upper felt belt 5 by means of the guide roll 11, the intended application of the paper web to the upper felt belt or band 5 can be effected.

The paper web together with the upper felt belt or band 5 also passes through the second or downstream pressing location 2, beyond which the paper web is taken off the upwardly guided upper felt belt 5 in that the paper web is guided at the lower press roll 4 of the second pressing location 2 and the upper felt belt or band 5 moves upwardly away. A transfer or pick-up roll 19 which is provided downstream of the second pressing location 2 serves in conjunction with a belt or band 20 for removing the paper web from the lower press roll 4 of the second pressing location 2 and for conveying the paper web into a drying section 8 of the papermaking machine.

According to the modification illustrated in a detail showing in FIG. 2, an additional pressing or press location 14 can be provided upstream of the transfer or pick-up roll 19. This additional pressing location 14 is formed between the lower press roll 4 guiding the paper web and a further roll or roller 15 and can produce a smoothing effect on both sides of the paper web.

A steaming box 12 or equivalent structure and provided with an associated suction box 13 is arranged upstream of the second pressing location 2 and especially serves for heating the paper web upstream of this second pressing location. The steaming box 12 is used for blowing or injecting heating steam onto the paper web which is guided at the upper felt belt or band 5. The upper pressing surfaces or press rolls 3 in the two separate or spaced pressing or press locations 1 and 2 advantageously comprise extended nip rolls, each of which encompass a stationary carrier or beam having a pressing or press shoe 23 as is well known in this technology. A rotatably arranged impervious flexible shell or tube of the extended nip roll is generally indicated by reference numeral 24.

To take up or absorb the liquid driven into the upper felt belt 5 and/or the lower felt belt 6 in the pressing or press locations 1 and/or 2 there are advantageously provided storage belts or bands 9 or the like between the associated felt belt and the related roll surface. Such storage belts or bands 9 are of known construction and can be constituted by felts, foils or wires which possess a large storage volume or capacity for the absorbed liquid or moisture.

On the left side of FIG. 1 there is shown the transfer of the paper web out of a wire section 16 of the papermaking machine into the pressing section comprising the separate or spaced pressing or press locations 1 and 2. The formed paper web on a lower wire 18 arrives at a transfer roll 21 where the paper web is taken over by the upper felt belt 5. The lower felt belt 6 is supplied or infed from below so that the paper web is guided between these two felt belts 5 and 6 to and through the first or upstream pressing or press location 1. After passing through this first pressing location 1, the lower felt belt 6 is deflected downward around the guide roll 11 and, as heretofore described, separated from the paper web so that re-wetting of the paper web is substantially prevented downstream of the first or upstream pressing location 1.

The dewatering in the pressing or press section according to the exemplary embodiment illustrated in FIG. 3 is effected according to the same principle or method previously described. However, in this second exemplary embodiment it is the lower felt belt or band 6 which extends through both the separate or spaced pressing or press locations 1 and 2, and the upper felt belt or band 5 travels solely through the first or upstream pressing or press location 1 and is deflected away from the paper web after passing through the first or upstream pressing or press location 1. In this manner, the paper web bears only upon the lower felt belt 6 when the paper web has passed the first pressing location 1 and then reaches the second or downstream pressing or press location 2. The paper web passes through this second pressing location 2 solely with the lower felt belt 6. It consistently follows that in this case, the guide roll or roller 11 is adjustably arranged to move downwards to the paper web lying upon the lower felt belt 6. This position of contact of the upper felt belt or band 5 and the guide roll or roller 11 with the paper web or the lower felt belt 6, as the case may be, is generally shown in broken lines. The guide roll or roller in this position of contact is indicated by reference numeral $11^1$. The transfer aspirator or suction device 10 is applied from below at the lower felt belt 6. In this second exemplary embodiment these two devices, namely the guide roll 11 and the transfer aspirator or suction device 10, have the task of ensuring reliable separation of the upper felt belt 5 from the paper web and supporting the take-up and retention of the paper web by and at the lower felt belt 6.

The steaming box or in this case the two steaming boxes 12 are also directed from above toward the paper web, and the two related suction boxes 13 are arranged or accommodated beneath the lower felt belt or band 6.

In this second exemplary embodiment the pressing surfaces or lower press rolls or rollers 4 of the pressing or press locations 1 and 2 are again advantageously constructed as extended nip rolls as already indicated and explained heretobefore.

As depicted at the left-hand side of FIG. 3 the formed paper web coming from the wire section 16 of the papermaking machine arrives at an upper belt or band 17 and is taken over at the lower felt belt 6 by means of a transfer roll 22. The upper felt belt 5 is supplied from above to the paper web, so that the paper web sandwiched between the upper felt belt 5 and the lower felt belt 6 is guided through the first or upstream pressing or press location 1. After this first pressing location 1 the upper felt belt 5 is deflected away from the paper web, so that the paper web bearing against the lower felt belt 6 is guided to and through the second or downstream pressing or press location 2. After passing through this second pressing location 2 the paper web remains on the upper press roll 3 of the second pressing location 2 and from where the paper web is supplied by means of the transfer or pick-up roll 19 and the belt or band 20 to the drying section 8 of the papermaking machine. The lower felt belt 6 is deflected downwardly after passing through the second pressing location 2 and after having been separated from the paper web.

Another possibility of transferring the paper web throughout a shortest possible path or stretch, and along which path the paper web is suspended below a felt or wire belt or band 5, is shown in FIG. 4. The formed paper web arrives on the lower wire 18 and is taken over by the upper felt belt or band 5 with the aid of a transfer or pick-up roll 21. The lower felt belt 6 is then supplied such that the paper web sandwiched between the two felt belts or bands 5 and 6 travels or leads into and through the first or upstream pressing or press location 1. In this manner, the task of taking on the formed paper web lies with the upper felt belt 5, while the lower felt belt 6 only has to guide the paper web through the two separate or spaced pressing or press locations 1 and 2 without any risk of the paper web falling off.

Figure 5:
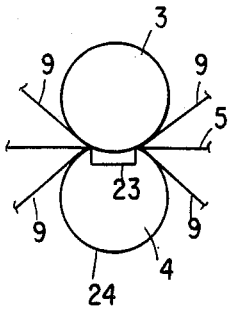
FIG. 5 schematically depicts a detail of a further modification of the first exemplary embodiment of FIG. 1.

FIG. 5 illustrates a variant of the exemplary embodiment of pressing or press section according to FIG. 1. The extended nip rolls in this case are constituted by the lower pressing surfaces or press rolls or rollers 4. The pressing or press shoe and the flexible tube or shell are here indicated by reference numerals 23 and 24 respectively.

FIG. 6 schematically shows an extended nip pressing or press location which is formed between two substantially planar or flat pressing or press shoes 27 and 28 as heretofore already mentioned.

Figure 7:
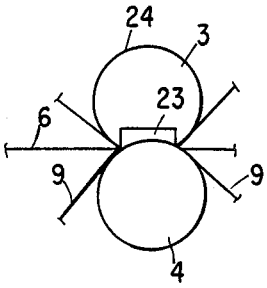
FIG. 7 schematically depicts a detail of a further modification of the second exemplary embodiment of FIG. 3.

Finally, FIG. 7 shows a variant of the exemplary embodiment of pressing or press section according to FIG. 3. The extended nip roll here comprises a pressing or press shoe 23 and a flexible tube or shell 24 and forms the upper pressing surface or press roll or roller 3.

While there are shown and described present preferred embodiments of the invention, it is to be distinctly understood that the invention is not limited thereto, but may be otherwise variously embodied and practiced within the scope of the following claims. ACCORDINGLY,

What I claim is:

1.

A pressing section of a papermaking machine for dewatering a paper web, comprising:

means defining a pair of pressing surfaces for each of two spaced and successively arranged pressing locations;

each pair of pressing surfaces comprising an upper pressing surface and a lower pressing surface;

said upper pressing surface and said lower pressing surface of each pair defining therebetween an extended nip;

a pair of felt belts for guiding therebetween a paper web having a predetermined direction of travel;

said pair of felt belts comprising an upper felt belt and a lower felt belt;

one pressing location of said two spaced pressing locations being arranged upstream of the other pressing location as viewed with respect to said predetermined direction of travel of the paper web;

said one pressing location defining a first pressing location;

said other pressing location defining a second pressing location;

one felt belt of said pair of felt belts travelling through both said spaced first and second pressing locations;

the other felt belt of said pair of felt belts extending together with said one felt belt solely through said first pressing location and being spaced from said paper web after passing through said first pressing location;

said paper web only being carried by said one felt belt when said paper web passes through said second pressing location;

said paper web being deflected away from said one felt belt downstream of said second pressing location in order to be conveyed into a drying section of said papermaking machine;

a guide roll arranged downstream of said first pressing location and provided for said other felt belt extending solely through said first pressing location;

said guide roll defining an adjustable guide roll which is positionally adjustable in a direction towards said paper web in order to ensure take-over and retention of said paper web by and at said one felt belt;

transfer suction means provided downstream of said first pressing location for the retention and take-over of said paper web at and by said one felt belt travelling through both said spaced first and second pressing locations;

such transfer suction means comprising a transfer suction device;

said adjustable guide roll together with said other felt belt selectively having a position of contact with said paper web and an operating position in which said adjustable guide roll is positioned away from said paper web;

said transfer suction device being structured and arranged for providing a vacuum as a function of which the position of said adjustable guide roll is controlled and said vacuum being maintained by the resistance of said one felt belt and said paper web;

means for constantly measuring said vacuum; and said adjustable guide roll together with said other felt belt being structured and arranged to be held at said paper web in said position of contact as long as said vacuum is below a predetermined value and held in said operating position away from said paper web as long as said vacuum exceeds said predetermined value.

2. The pressing section as defined in claim 1, wherein:

an angle of departure between said other felt belt and said paper web in said operating position of said adjustable guide roll is within the range of 2° to 10°.

3. The pressing sections as defined in claim 1, wherein:

said upper felt belt constitutes said one felt belt travelling through both said spaced first and second pressing locations.

4. The pressing section as defined in claim 1, wherein:

said lower felt belt constitutes said one felt belt travelling through both said spaced first and second pressing locations.

5. The pressing section as defined in claim 1, further including:

storage belt means for taking up liquid expressed out of the paper web and provided at said spaced first and second pressing locations between said one felt belt and an associated pressing surface of each pair of pressing surfaces.

6. The pressing section as defined in claim 1, further including:

a storage belt for taking up liquid expressed out of the paper web and provided at each of said spaced first and second pressing locations between said one felt belt and an associated pressing surface of each pair of pressing surfaces; and a further storage belt for taking up liquid expressed out of the paper web and provided at said first pressing location between said other felt belt and an associated pressing surface of said pair of pressing surfaces of said first pressing location.

7. The pressing section as defined in claim 1, further including:

a storage belt for taking up liquid expressed out of the paper web and provided at said first pressing location between said other felt belt and an associated pressing surface of said pair of pressing surfaces of said first pressing location.

8. The pressing section as defined in claim 1, further including:

a steaming box arranged at least upstream of said second pressing location for injecting heating steam onto said paper web in order to heat the paper web.

9. The pressing section as defined in claim 1, wherein:

a pressing surface of said pair of pressing surfaces of said second pressing location comprises a press roll;

said press roll guiding said paper web; and a further roll arranged downstream of said second pressing location to form together with said press roll an additional pressing location before said paper web is conveyed to said drying section of said papermaking machine.

10. A pressing section of a high speed papermaking machine for dewatering a paper web, comprising:

means defining a pair of pressing surfaces for each of two spaced and successively arranged pressing locations;

each pair of pressing surfaces comprising a first pressing surface and a second pressing surface;

said first pressing surface and said second pressing surface of each pair defining therebetween nip means;

a pair of felt belts for guiding therebetween a paper web having a predetermined direction of travel;

said pair of felt belts comprising a first felt belt and a second felt belt;

one pressing location of said two spaced pressing locations being arranged upstream of the other pressing location as viewed with respect to said predetermined direction of travel of the paper web;

said one pressing location defining a first pressing location;

said other pressing location defining a second pressing location;

one felt belt of said pair of felt belts extending through both said spaced first and second pressing locations;

the other felt belt of said pair of felt belts extending together with said one felt belt only through said first pressing location and being spaced from said paper web after passing through said first pressing location;

said paper web only contacting said one felt belt during such time as said paper web passes through said second pressing location;

said paper web being guided away from said one felt belt downstream of said second pressing location;

a displaceable guide roll arranged downstream of said first pressing location and provided for said other felt belt extending only through said first pressing location;

transfer suction means arranged downstream of said first pressing location provided for said one felt belt for providing a vacuum as a function of which the position of the displaceable guide roll is controlled;

means for continually measuring said vacuum; and said displaceable guide roll being positionally adjustable in response to the measured vacuum in a direction towards said one felt belt in order to ensure take-over and retention of said paper web by and at said one felt belt.

* * * * *